US010760206B1

(12) United States Patent
Carr

(10) Patent No.: US 10,760,206 B1
(45) Date of Patent: Sep. 1, 2020

(54) DEVICE FOR TRIMMING FABRIC

(71) Applicant: New Leaf Stitches, LLC, Fergus Falls, MN (US)

(72) Inventor: Kari M. Carr, Fergus Falls, MN (US)

(73) Assignee: New Leaf Stitches, LLC, Fergus Falls, MN (US)

( * ) Notice: Subject to any disclaimer, the term of this patent is extended or adjusted under 35 U.S.C. 154(b) by 73 days.

(21) Appl. No.: 15/935,975

(22) Filed: Mar. 26, 2018

Related U.S. Application Data

(60) Provisional application No. 62/477,040, filed on Mar. 27, 2017.

(51) Int. Cl.
*B43L 7/027* (2006.01)
*B43L 13/20* (2006.01)
*D06H 7/04* (2006.01)

(52) U.S. Cl.
CPC ..... *D06H 7/04* (2013.01); *B43L 7/0275* (2013.01); *B43L 13/20* (2013.01)

(58) Field of Classification Search
CPC ..... B43L 7/00; B43L 7/027; B43L 7/0275; B43L 13/20
USPC ..... 33/566
See application file for complete search history.

(56) References Cited

U.S. PATENT DOCUMENTS 720,824 A * 2/1903 Lieber ..... B43L 13/205 33/566
1,751,366 A * 3/1930 Shaub ..... B43L 7/0275 33/476
2,954,612 A * 10/1960 Goldberger ..... B43L 7/00 33/566
5,058,285 A * 10/1991 Morita ..... B43L 13/205 33/447
RE34,374 E * 9/1993 Davidson ..... B43L 7/14 144/144.51
5,319,859 A * 6/1994 Smith ..... B43L 13/205 33/11
7,854,073 B1 * 12/2010 Webb ..... D05B 97/12 33/1 G
8,156,877 B1 * 4/2012 Carr ..... D05B 35/10 112/117

(Continued)

OTHER PUBLICATIONS

Cozyquilt.com; "Strip Tube Ruler"; https://cozyquilt.com/Aspx/ProductDetails.aspx?productID=517; last retrieved Feb. 25, (including Strip Tubing "Flow to Video"); Exhibit A and Exhibit C.

(Continued)

*Primary Examiner* — Christopher W Fulton
(74) *Attorney, Agent, or Firm* — Brie A. Crawford; Crawford Intellectual Property Law LLC

(57) ABSTRACT

A device incorporating visible alignment features which allow the precision trimming of fabric into geometric shapes of a fixed size is disclosed. The device also allows trimming of fabric figures composed of simpler geometric shapes, including guides for rotary trimmers or other cutting implements to remove excess fabric at the seam created by the most common method of creating such figures, to produce figures of specified size and shape with no measuring required. The device incorporates a plurality of trimming slots and indexing indicators allowing it to be used to produce such figures. A method of using the device to produce multiple final fabric pieces from a single section of base fabric is also disclosed.

9 Claims, 6 Drawing Sheets

(56) References Cited

U.S. PATENT DOCUMENTS

| | | | | |
|---|---|---|---|---|
| 8,397,396 | B2 * | 3/2013 | Nethery | B43L 7/005 33/563 |
| 2006/0032068 | A1 * | 2/2006 | Sherman | G01B 1/00 33/566 |
| 2009/0083984 | A1 * | 4/2009 | Platt | B26B 29/06 33/492 |
| 2011/0048186 | A1 * | 3/2011 | Thomas | B26B 29/06 83/13 |

OTHER PUBLICATIONS

Creative Grids USA; "Creative Grids 90 Degree Quarter-Square Triangle Quilt Ruler"; https://www.creativegridsusa.com/products/CGRT90; last retrieved Feb. 25, 2020; Exhibit B.

* cited by examiner

DEVICE FOR TRIMMING FABRIC

PRIORITY CLAIM

This application claims priority from one or more previously filed Provisional Patent Applications, namely:

1) DEVICE FOR TRIMMING FABRIC, Application No. 62/477,040, Filed Mar. 27, 2017.

This invention relates to a device which uses multiple trimming slots and associated indexing indicators to enable precise trimming of fabric to form geometric shapes and larger composite pieces composed of smaller geometric shapes, including precision edging and excess material left by the most common means of forming such composite pieces. A method for using the device is also disclosed.

BACKGROUND OF THE INVENTION

Forming geometrically precise figures in fabric or other materials is an old problem in the art. In particular, those who practice the textile art form commonly referred to as "quilting" incorporate many geometric figures, usually composed of triangles or conglomerations of triangles, into their art. It is difficult to form these figures perfectly because human beings are inherently imprecise in their measurements and movements when cutting and sewing fabric.

If great care is taken to form precise fabric components, the degree of precision of the final composite figure is improved, but the sewing may lower the precision of the final composite figure. If greater care is taken in the sewing, the degree of precision of the final composite figure may also be improved, but the degree of precision of the initial components may play a larger role. An invention which compensates for both any imprecision in the initial preparation of the fabric components and any imprecision in the sewing of the final composite figure will be a useful invention.

The present invention addresses these concerns.

SUMMARY OF THE INVENTION

Among the many objectives of the present invention is the provision of a device which allows the creation of precision final fabric figures without the necessity of precise measurements of the component pieces.

Another objective of the present invention is the provision of a device which allows the creation of a variety of precision final fabric figures while using a limited number of application techniques for quick and simple production of the final fabric figures.

These and other objectives of the invention (which other objectives become clear by consideration of the specification and drawings as a whole) are met by providing the device and methods for trimming fabric set forth in the specification hereof.

DESCRIPTION OF THE PREFERRED EMBODIMENTS

Figure 1:
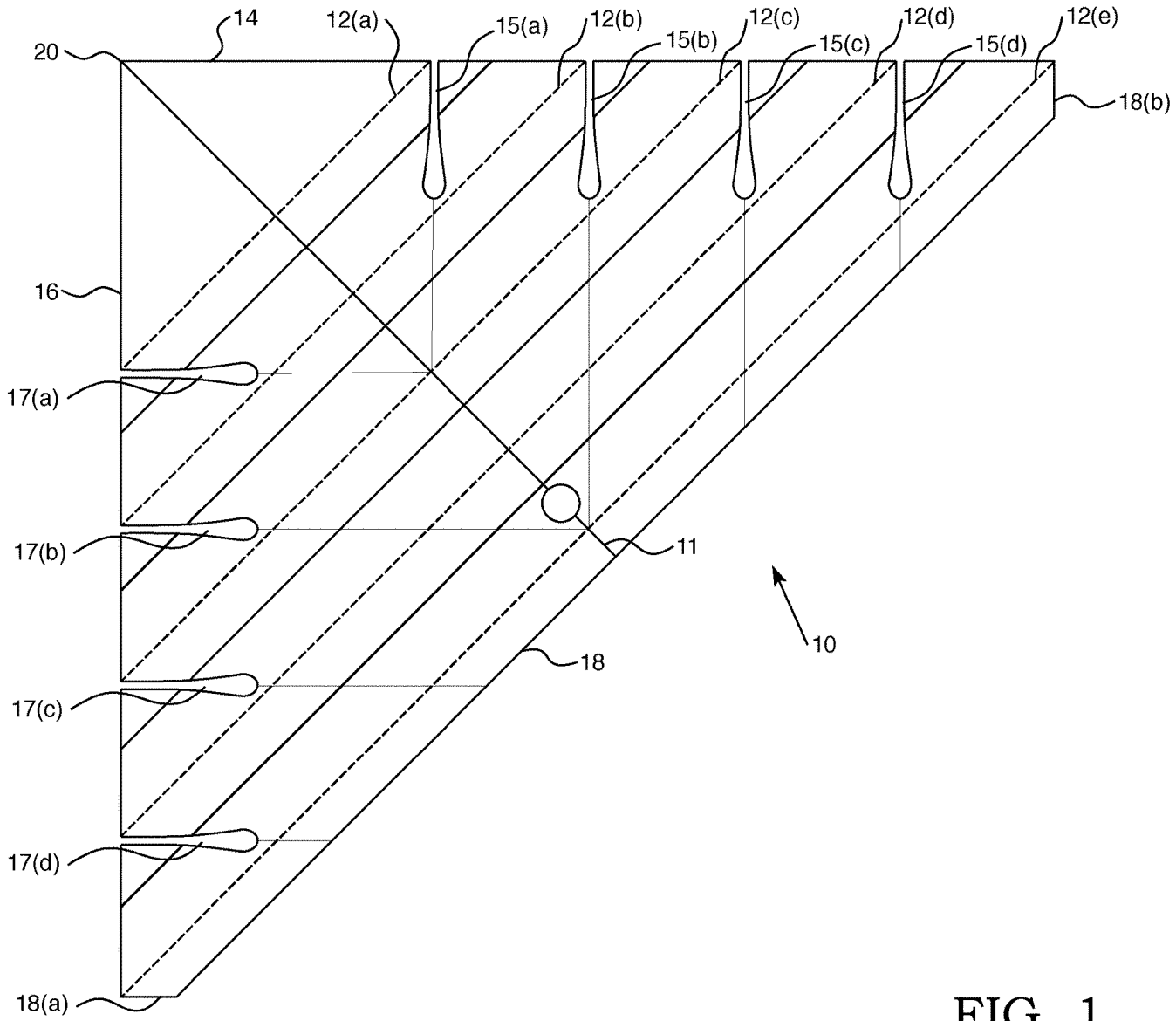
FIG. 1 depicts an overhead view of the device for trimming fabric.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

Now adding FIG. 1 to the consideration, the configuration of the invention may be clearly understood. Slotted trimmer 10 has right side 14 containing right trim slots 15(*a*), 15(*b*), 15(*e*), and 15(*d*), and left side 16 with corresponding left trim slots 17(*a*), 17(*b*), 17(*c*), and 17(*d*). Trim indicators 12(*a*), 12(*b*), 12(*c*), 12(*d*), and 12(*e*) cross the body of slotted trimmer 10 at right angles to center line 11. Every trim indicator, except those denoted by (e), has a corresponding pair of trim slots with the same letter designation: each trim indicator corresponds to a denoted size for the final piece (See FIG. 2.) Center line 11 connects apex 20 to bottom 18, which has left trim edge 18(*a*) and right trim edge 18(*b*), which are to be used if the size of the final piece (see FIG. 2) corresponds to trim indicator 12(*e*). It is strongly preferred, but not required, that slotted trimmer 10 be made of a transparent or highly translucent material. It is preferred, but not required, that all trim indicators and the center line be made of or marked with an opaque material. It is optional, but neither preferred nor required, to create the trim indicators as part of the molding or casting of the slotted trimmer. They can be either raised or lowered areas of the molding or casting if this is done: neither is preferred.

Figure 2:
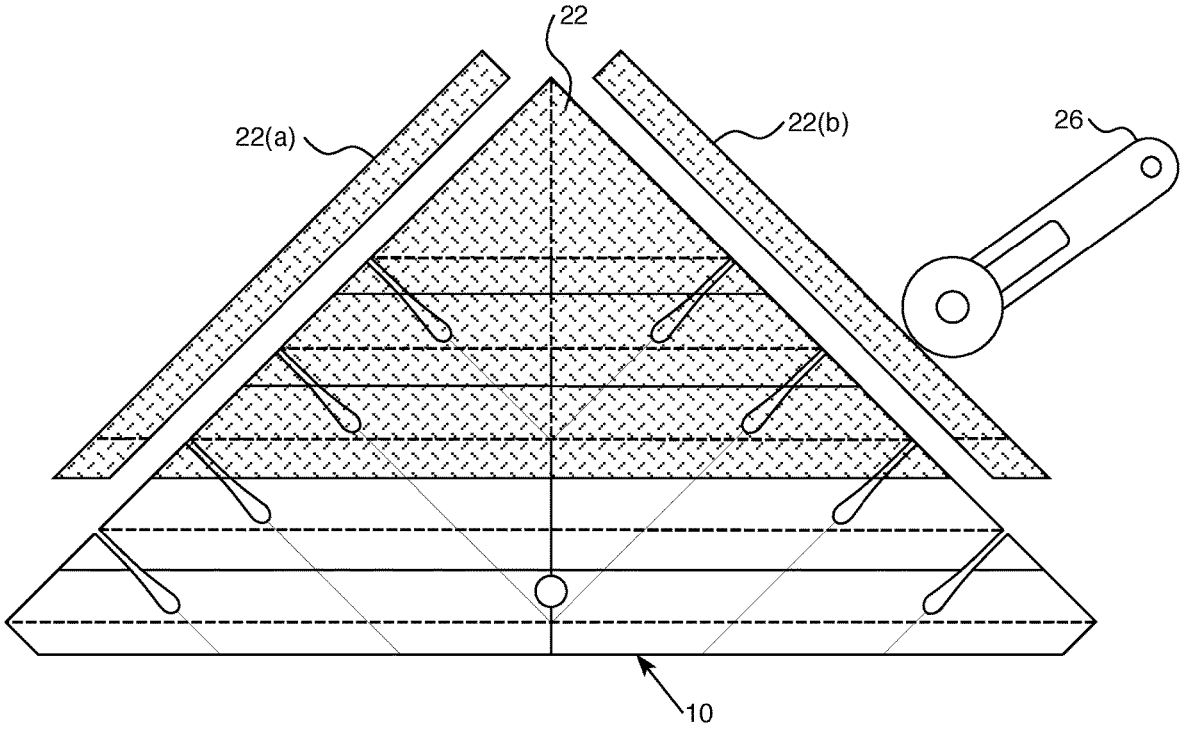
FIG. 2 depicts an overhead view of the device for trimming fabric in operation.

Now adding FIG. 2 to the consideration, the first part of the basic operation of the invention can be seen. Slotted trimmer 10 has been placed on top of fabric 22. Rotary cutter 26 has been run along the right side and the left side of the slotted trimmer (see FIG. 1) and removed left trim piece 22(*a*) and right trim piece 22(*b*). It is preferred, but not required, that fabric 22 comprise a square comprised of two pieces of fabric, each a right isosceles triangle, joined by a seam at their hypotenuses. It is required, if this is the case, that fabric 22 be aligned at the seam with the trim indicator corresponding to the desired final size of fabric 22 after trimming is complete. Any suitable cutting device, such as a razor blade, craft knife, or a pair of scissors, can be used to perform the actual cutting of fabric 22.

Figure 3:
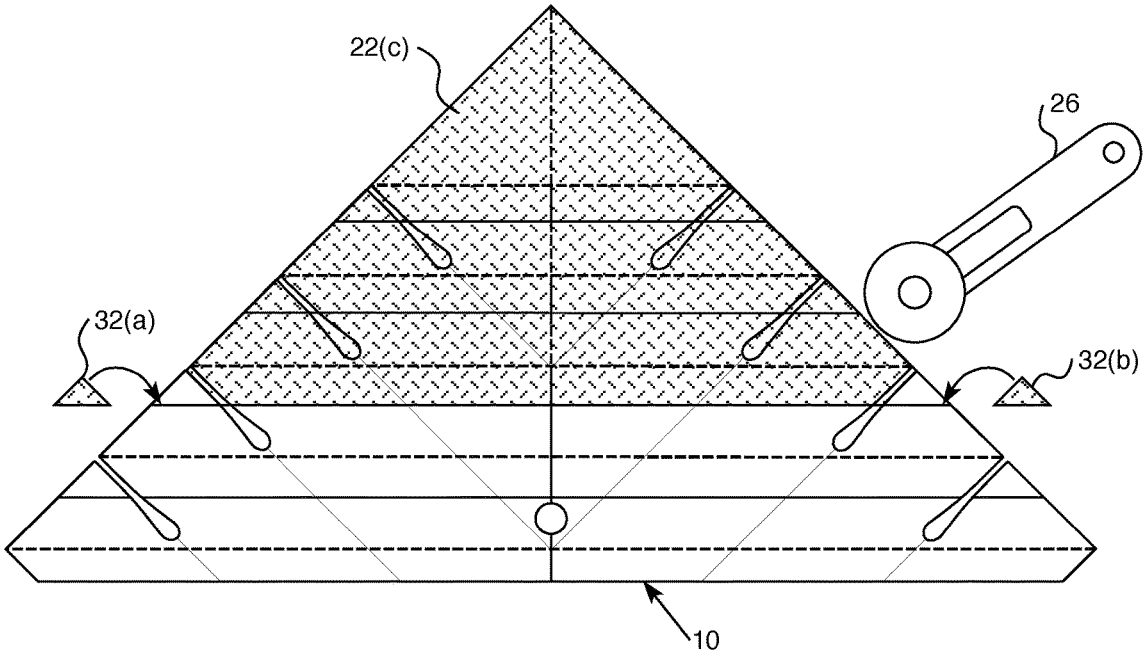
FIG. 3 depicts an overhead view of the device for trimming fabric in a first alternate method of operation.

In FIG. 3, the second part of the basic operation of the invention can be seen. Rotary cutter 26 has been run through the appropriate trim slots (here, left trim slot 17(*c*) and right trim slot 15(*c*), see FIG. 1.) This has removed left dog-ear 32(*a*) and right dog-ear 32(*b*). The fabric being trimmed is now final fabric piece 22(*c*), which is what remains of fabric 22 (see FIG. 2) after left trim piece 22(*a*), right trim piece 22(*b*), left dog-ear 32(*a*), and right dog-ear 32(*b*) have been removed. Removal of the dog-ears prevents excess material from protruding from the corners when fabric 22 is opened. If fabric 22 comprised a square comprised of two pieces of fabric, each a right isosceles triangle and joined by a seam at their hypotenuses, the result is final fabric piece 22(*c*) as shown in in FIG. 4. Final fabric piece 22(*c*) can be opened along the seam to produce half-square triangle piece 22(*d*).

Figure 4:
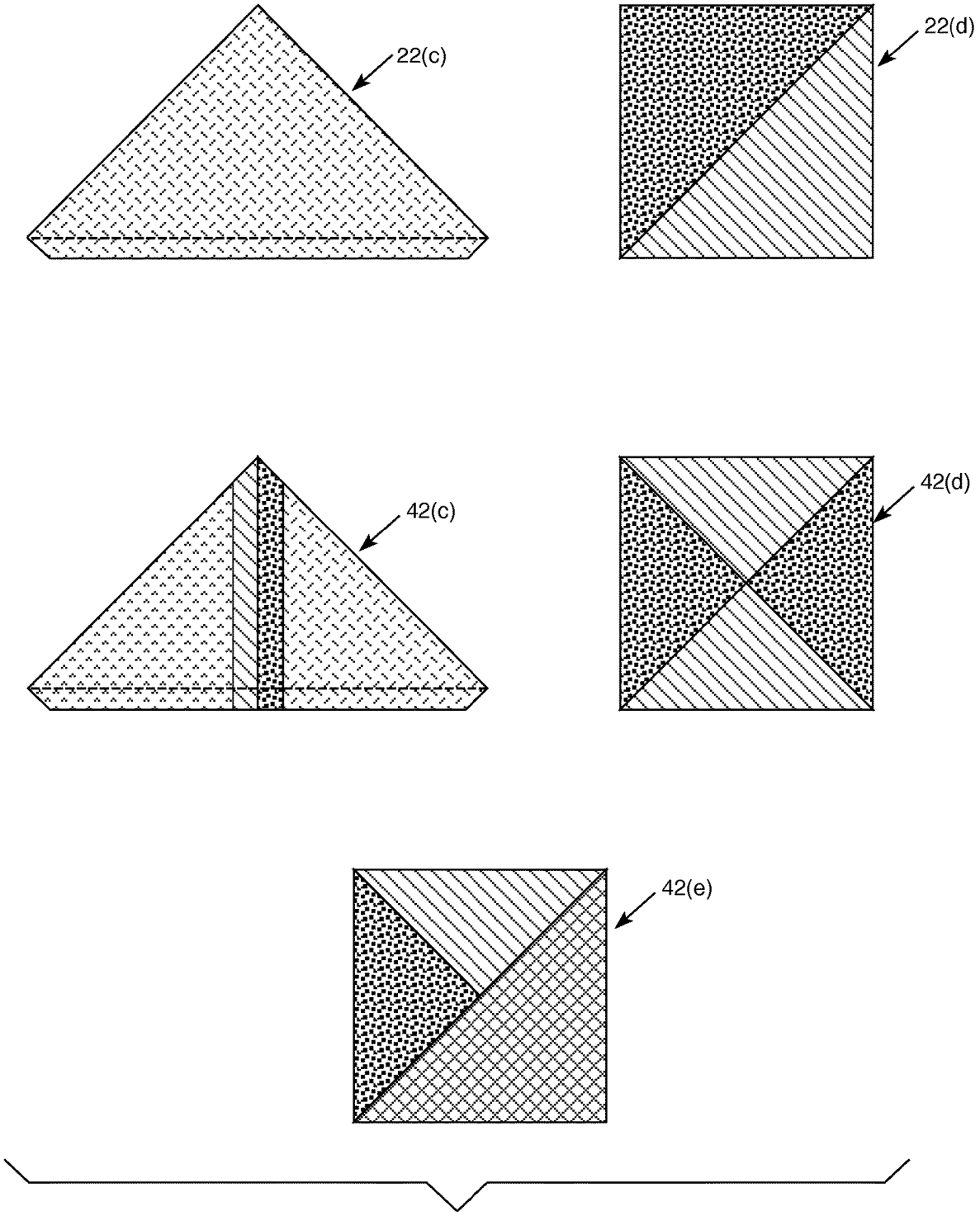
FIG. 4 depicts an overhead view of the outputs of the device for trimming fabric in a second alternate method of operation.

FIG. 4 depicts the result of an operation of the invention on a modified base fabric. Final fabric piece 22(*c*) (when opened 22(*d*)) comprises two right isosceles triangles sewn together to make a square. In place of the base fabric previously described, a second fabric, comprising either two or three right isosceles triangles sewn together to make a square can be used. Shown is a configuration with two triangles, second fabric 42(*c*) (which when opened becomes an alternate final piece, specifically quarter-square triangle 42(*d*)). When slotted trimmer 10 (see FIG. 2) is used in the same manner as in the descriptions of FIGS. 2 and 3, the result is either quarter-square triangle 42(*d*) or three-piece triangle square 42(*e*), depending on whether the second fabric comprised two or three triangles.

Figure 5:
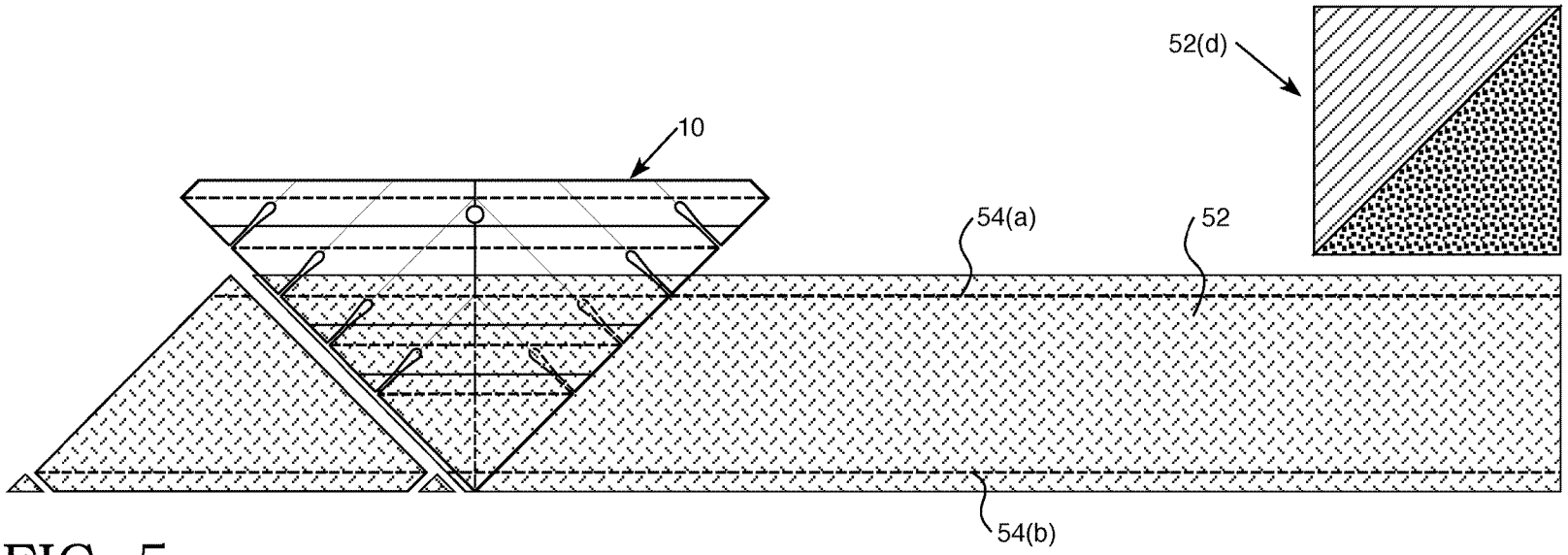
FIG. 5 depicts an overhead view of the device for trimming fabric in a third alternate method of operation.

FIG. 5 shows a second alternate technique for using the invention. Third fabric 52 comprises two identically-sized rectangular pieces of fabric placed on top of each other and attached with top seam 54(*a*) and bottom seam 54(*b*). This creates a tube of fabric. Slotted trimmer 10 can be placed with the appropriate trim indicator (here trim indicator 12(*c*), see FIG. 1) aligned with top seam 54(*a*). The same trimming steps as shown in the description of FIGS. 2 and 3 are then applied, producing second final fabric piece 52(*d*). Slotted trimmer 10 can then be rotated 180 degrees and the appropriate trim indicator aligned with bottom seam 54(*b*). Upon performing the trimming steps again, another final fabric piece will be created. This series of rotation/trimming steps can be repeated as desired or until not enough of third fabric 52 remains to create another final fabric piece. As appropriate, the process can be started with the trimmer aligned with the top seam or the bottom seam.

Figure 6:
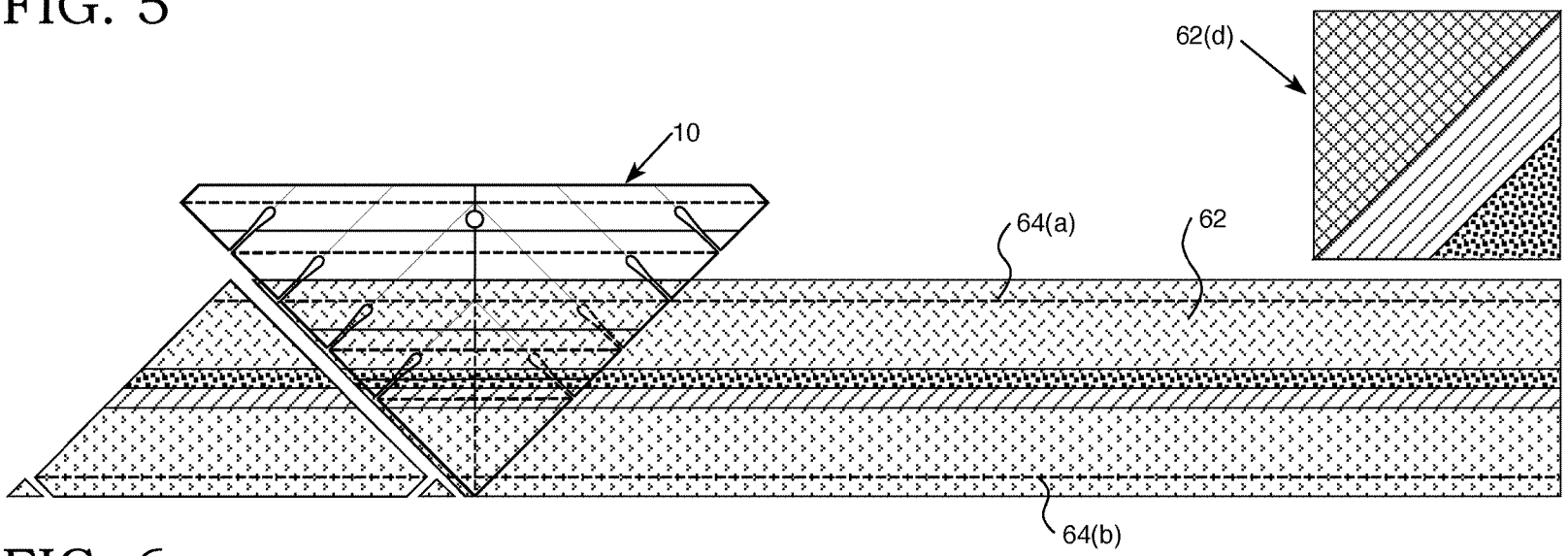
FIG. 6 depicts an overhead view of the device for trimming fabric in a fourth alternate method of operation.

FIG. 6 discloses a third alternate technique for using the invention. Fourth fabric 62 comprises two identically-sized rectangular pieces of fabric attached to form a larger rectangular piece, and a third rectangular piece which is the same size as the piece formed by joining the first two pieces of fabric. The larger rectangular piece is then laid on top of the third rectangular piece and attached with top seam 64(*a*) and bottom seam 64(*b*). This creates a tube of fabric. Slotted trimmer 10 can be placed with the appropriate trim indicator (here trim indicator 12(*c*), see FIG. 1) aligned with top seam 64(*a*). The same trimming steps as shown in the description of FIGS. 2 and 3 are then applied, producing third final fabric piece 62(*d*). Slotted trimmer 10 can then be rotated 180 degrees and the appropriate trim indicator aligned with bottom seam 64(*b*). Upon performing the trimming steps again, another final fabric piece will be created. This series of rotation/trimming steps can be repeated as desired or until not enough of fourth fabric 62 remains to create another final fabric piece. As appropriate, the process can be started with the trimmer aligned with the top seam or the bottom seam.

Figure 7:
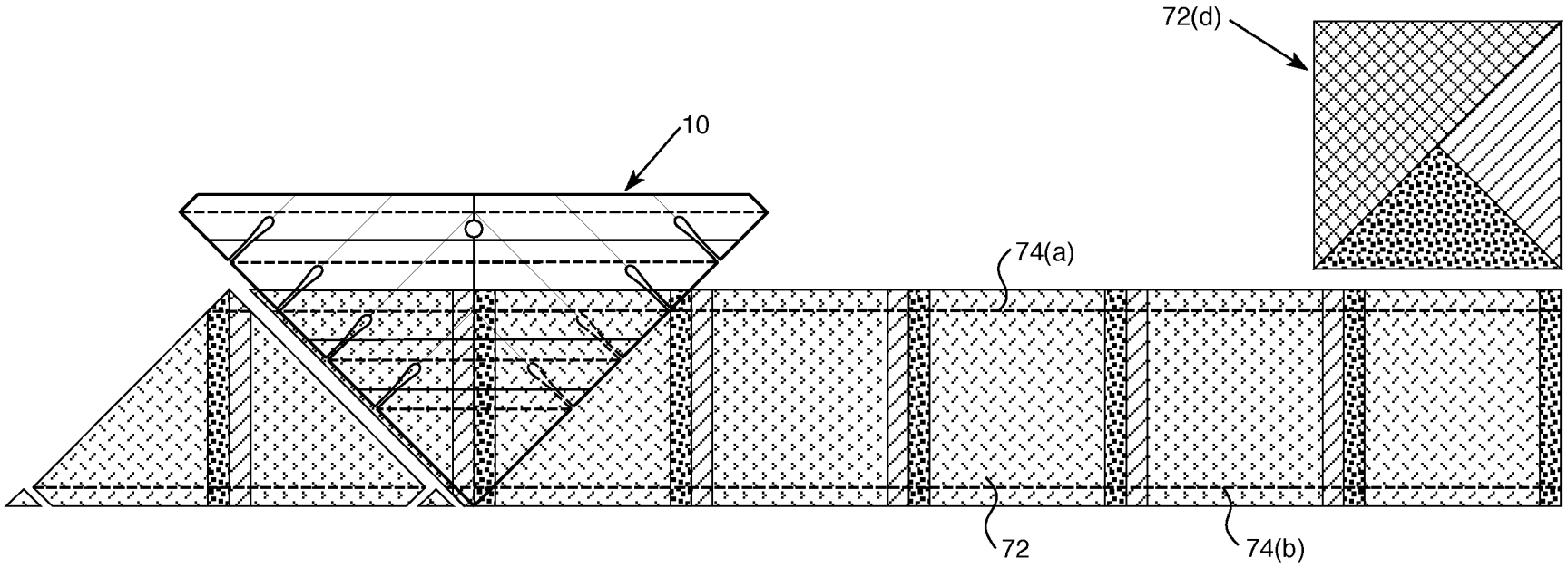
FIG. 7 depicts an overhead view of the output of the device for trimming fabric in a fifth alternate method of operation.

FIG. 7 reveals a fourth alternate technique for using the invention. Fifth fabric 72 comprises two identically-sized rectangular pieces of fabric placed on top of each other. One of the two identically-sized pieces of fabric is comprised of multiple pieces of rectangular fabric which have been joined in an alternating pattern, forming a strip-piece fabric with a pattern created by the alternate inclusion of the multiple pieces. The strip-piece fabric is then joined to a single piece of fabric with the same dimensions as the strip-piece fabric, and attached with top seam 74(*a*) and bottom seam 74(*b*). This creates a tube of fabric. Slotted trimmer 10 can be placed with the appropriate trim indicator (here trim indicator 12(*c*), see FIG. 1) aligned with top seam 74(*a*). The same trimming steps as shown in the description of FIGS. 2 and 3 are then applied, producing fourth final fabric piece 72(*d*). Slotted trimmer 10 can then be rotated 180 degrees and the appropriate trim indicator re-aligned with bottom seam 74(*b*). Upon performing the trimming steps again, another final fabric piece will be created. This series of rotation/trimming steps can be repeated as desired or until not enough of third fabric 72 remains to create another final fabric piece. As appropriate, the process can be started with the trimmer aligned with the top seam or the bottom seam.

For clarity, the method of operation of the invention comprises the following consecutive steps:

Step 1: Create an appropriate piece of fabric to be trimmed into a final piece. Preferably, this will be a square composed of two or more pieces of fabric, each a triangle. If more than one final piece is desired, the user may either create multiple pieces of fabric to be trimmed, or create a rectangular tube of fabric by joining two or more pieces of fabric with two longitudinal seams. The pieces of fabric to be joined may themselves be comprised of multiple pieces of fabric.

Step 2: Align the appropriate trim indicator on the slotted trimmer with the seam of the two pieces of fabric which were joined to create the piece of fabric to be trimmed.

Step 3: Trim the fabric with a rotary cutter or other appropriate cutting tool along the right and left edges of the slotted trimmer.

Step 4a: If the size of the final piece corresponds to the size associated with one of the trim indicators which is not the final trim indicator, trim the fabric along the right and left trim slots corresponding to the size of the final piece.

Step 4b: (Alternate to Step 4a.) If the size of the final piece corresponds to the size of the slotted trimmer at its final trim indicator, trim the fabric along the right and left trim edges.

Step 5: Open the fabric to reveal the final piece. If necessary, separate the corners of the fabric furthest away from the seam(s) to allow the fabric to open.

Step 6: (Optional.) If the fabric comprises a rectangular tube as in FIGS. 5, 6, and 7, rotate the slotted trimmer or the fabric 180 degrees, align the appropriate trim indicator with the seam of the rectangular tube, and repeat steps 3, 4, and 5.

In an optional extended method of operation, center line 11 (see FIG. 1) can be used to align the slotted trimmer when the components of the final piece have a width which is substantially shorter than the width of the base fabric. See examples 42(*c*), 42(*d*), and 42(*e*) in FIG. 4, and fabric 72 resulting in final piece 72(*d*) in FIG. 7. Center line 11 allows the slotted trimmer to be aligned with the vertical seams which connect the components of the base fabric 72 as shown in FIG. 7.

While it is strongly preferred that the invention be embodied as a triangular device as shown in FIG. 1, the teaching of the invention can be used in a variety of alternate embodiments. These embodiments do not allow the multiple geometries of final piece(s) made possible by the embodiment described in FIG. 1, as shown in FIG. 4, and to obtain the benefit of those multiple geometries, it is required that the device be triangular.

Figure 8:
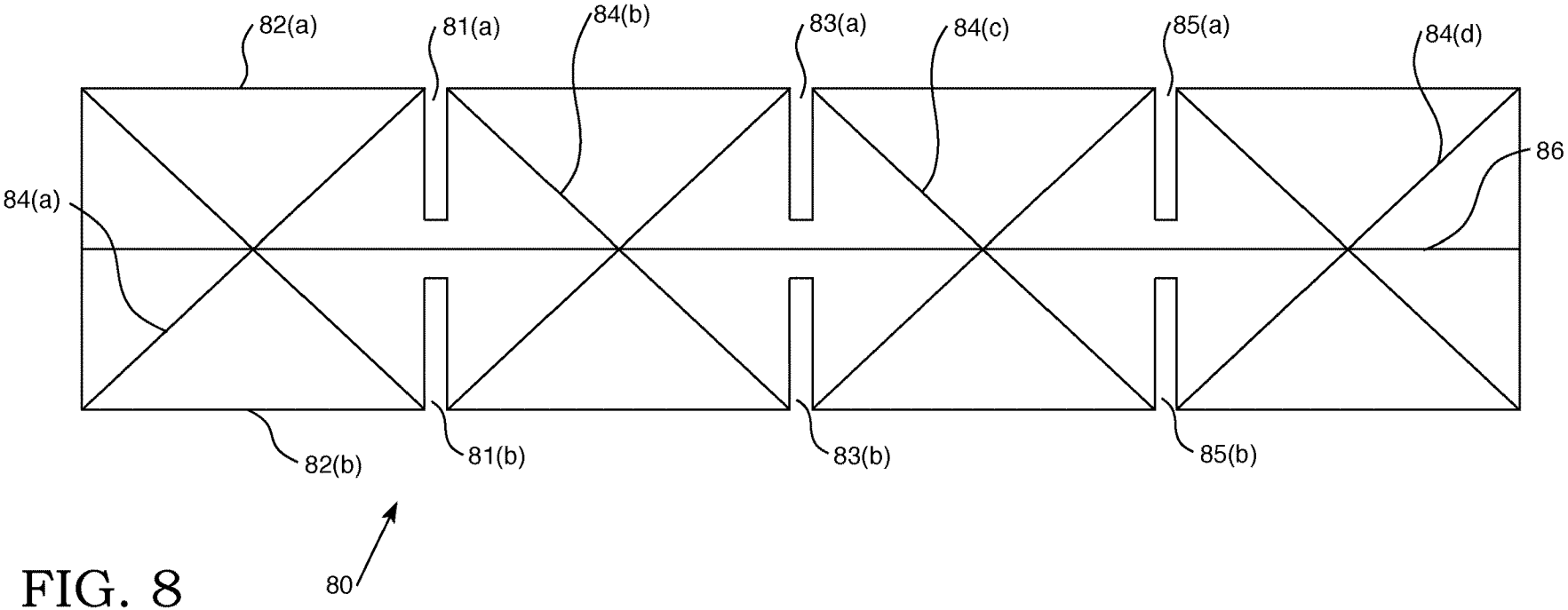
FIG. 8 depicts an alternate embodiment of the device.

FIG. 8 shows an alternate embodiment of the device. Straight slotted trimmer 80 has top edge 82(*a*) which includes top trim slots 81(*a*), 83(*a*), and 85(*a*), and bottom edge 82(*b*) which includes bottom trim slots 81(*b*), 83(*b*), and 85(*b*). Straight slotted trimmer 80 includes center index marking 86 and angle index markings 84(*a*), 84(*b*), 84(*c*), and 84(*d*). It is strongly preferred that straight slotted trimmer 80 be formed of a translucent or transparent material. The index markings can be formed of raised and/or lowered areas I the molding or casting of straight slotted trimmer 80, or formed by painting, engraving, or otherwise marking straight slotted trimmer 80.

To use straight slotted trimmer 80, the top or bottom edges and/or the center index marking and/or angle index markings are aligned with the desired trim points of a fabric piece, analogously to the process described in FIGS. 2, 3, 5, 6, and 7. As will be apparent to a person of ordinary skill in the art, the geometries made possible by any particular configuration of an embodiment of the slotted trimmer will produce analogous geometries in the final pieces produced by use of that configuration. These could include, but are not limited to, slotted trimmers with any desired linear angle configuration, a semi-circular configuration, an elliptical configuration, a smooth curve configuration, or any combination of these configurations. These would produce, respectively, final pieces with linear angles, semi-circular final pieces, elliptical final pieces, smoothly curved final pieces, and final pieces with combinations of these characteristics. It is required that the base fabric used with any particular embodiment of the invention be of a sufficient size that at least one trim slot and at least one trim indicator can be properly aligned to produce a final piece with the desired geometric configuration.

A second alternate embodiment (not shown) could also include trim slots only along a single edge. This second alternate embodiment could be used to form final pieces requiring trimming only on one side, or could be reoriented (e.g. flipped over or rotated) after performing a first plurality of trim operations to perform a second plurality of trim operations on the base fabric to produce a final piece with a plurality of trimmed areas.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure. It should be noted that the order of the steps in all disclosed embodiments may be varied as will be obvious to a person of ordinary skill in the art.

Because of this disclosure and solely because of this disclosure, modification of this device and method for trimming fabric can become clear to a person having ordinary skill in this particular art. Such modifications are clearly covered by this disclosure.

What is claimed and sought to be protected by Letters Patent is:

1. A slotted fabric trimmer comprising:

a) a trimmer body having a shape, the shape being that of a right isosceles triangle having a right side, a left side, and a base, the base being a hypotenuse of the right isosceles triangle, the base having a right truncation and a left truncation, the right and left truncations truncating the right side and the left side where the right side and the left side intersect the base such that the base has a left truncated edge parallel to the right side and a right truncated edge parallel to the left side;

b) a center line connecting an apex of the trimmer body to the base, the apex being the point where the right side intersects the left side;

c) a plurality of trim indicators visible on the trimmer body, the plurality of trim indicators being tangent to the left side and the right side and orthogonal to the center line, one of the plurality of trim indicators being a base trim indicator, the base trim indicator being tangent to the right side, the left side, the right truncated edge, and the left truncated edge;

d) a plurality of right side trim slots on the right side, each right side trim slot comprising a void in the trimmer body which is open on the right side and enters into the trimmer body such that a cutting tool can trim a material in proximity to the trimmer body by passing through one or more right side trim slots, each right side trim slot parallel to the left side and corresponding to one of the trim indicators which is not the base trim indicator; and, e) a plurality of left side trim slots on the left side, each left side trim slot comprising a void in the trimmer body which is open on the left side and enters into the trimmer body such that the cutting tool can trim the material by passing through one or more of the left side trim slots, each left side trim slot parallel to the right side and corresponding to one of the trim indicators which is not the base trim indicator.

2. A slotted fabric trimmer as in claim 1 wherein each of the plurality of trim indicators are equidistant from each other along the center line.

3. A slotted fabric trimmer as in claim 2 wherein the trimmer body is made of a transparent material.

4. A slotted fabric trimmer as in claim 3 wherein the trim indicators comprise raised or lowered areas of the trimmer body.

5. A slotted fabric trimmer as in claim 2 wherein the trim indicators comprise raised or lowered areas of the trimmer body.

6. A slotted fabric trimmer as in claim 1 wherein the trimmer body is made of a transparent material.

7. A slotted fabric trimmer as in claim 6 wherein the trim indicators comprise raised or lowered areas of the trimmer body.

8. A slotted fabric trimmer as in claim 1 wherein the trim indicators comprise raised or lowered areas of the trimmer body.

9. A method of trimming fabric comprising the steps of:

a) using a slotted trimmer comprising:

i) a trimmer body having a shape, the shape being that of a right isosceles triangle having a right side, a left side, and a base, the base being a hypotenuse of the right isosceles triangle, the base having a right truncation and a left truncation, the right and left truncations truncating the right side and the left side where the right side and the left side intersect the base such that the base has a left truncated edge parallel to the right side and a right truncated edge parallel to the left side;

ii) a center line connecting an apex of the trimmer body to the base, the apex being the point where the right side intersects the left side;

iii) a plurality of trim indicators visible on the trimmer body, the plurality of trim indicators being tangent to the left side and the right side and orthogonal to the center line, one of the plurality of trim indicators being a base trim indicator, the base trim indicator being tangent to the right side, the left side, the right truncated edge, and the left truncated edge;

iv) a plurality of right side trim slots on the right side, each right side trim slot comprising a void in the trimmer body which is open on the right side and enters into the trimmer body such that a cutting tool can trim a material in proximity to the trimmer body by passing through one or more right side trim slots, each right side trim slot parallel to the left side and corresponding to one of the trim indicators which is not the base trim indicator; and v) a plurality of left side trim slots on the left side, each left side trim slot comprising a void in the trimmer body which is open on the left side and enters into the trimmer body such that the cutting tool can trim the material by passing through one or more of the left side trim slots, each left side trim slot parallel to the right side and corresponding to one of the trim indicators which is not the base trim indicator;

b) selecting a base fabric to be trimmed into a final piece, the base fabric comprising one or more fabric pieces, the base fabric having a seam if the base fabric comprises more than one fabric piece;

c) aligning the selected trim indicator of the slotted trimmer, the slotted trimmer having the right side with the plurality of right trim slots and the right truncated edge, the left side with the plurality of left trim slots and the left truncated edge, and the plurality of trim indicators including the base trim indicator, with at least one of: an edge of the base fabric, a fold in the base fabric, or the seam of the base fabric;

d) trimming the fabric with the cutting tool along the right side and the left side of the slotted trimmer;

e) trimming the fabric along the right trim slot and the left trim slot corresponding to a selected size of the final piece if the selected size of the final piece corresponds to an associated size associated with one of the plurality of trim indicators which is not the base trim indicator;

f) trimming the fabric along the right and left truncated edges if the size of the final piece corresponds to the size of the slotted trimmer at its base trim indicator; and, g) opening the base fabric to reveal the final piece.

* * * * *